US006693788B1

(12) United States Patent
Partridge

(10) Patent No.: US 6,693,788 B1
(45) Date of Patent: Feb. 17, 2004

(54) AIR IONIZER WITH STATIC BALANCE CONTROL

(75) Inventor: Leslie W. Partridge, Davis, CA (US)

(73) Assignee: Ion Systems, Berkeley, CA (US)

( * ) Notice: Subject to any disclaimer, the term of this patent is extended or adjusted under 35 U.S.C. 154(b) by 312 days.

(21) Appl. No.: 09/853,081

(22) Filed: May 9, 2001

(51) Int. Cl.[7] ..... H01T 23/00
(52) U.S. Cl. ..... 361/231; 361/225; 361/230
(58) Field of Search ..... 361/231, 212, 361/225, 233, 230

(56) References Cited

U.S. PATENT DOCUMENTS 2,879,395 A * 3/1959 Walkup ..... 250/325

6,002,573 A * 12/1999 Partridge ..... 361/231

* cited by examiner

*Primary Examiner*—Brian Sircus
*Assistant Examiner*—James A Demakis
(74) *Attorney, Agent, or Firm*—Fenwick & West LLP

(57) ABSTRACT

Air ionization apparatus includes a plurality of air ionizing electrodes connected to a source of high ionizing voltages, and includes a bias source connected to supply bias voltage to a reference electrode positioned near the air ionizing electrodes to alter the field gradients thereabout to selectively enhance production of positive or negative air ions in response to levels and polarity of bias voltage supplied to the reference electrode.

10 Claims, 2 Drawing Sheets

AIR IONIZER WITH STATIC BALANCE CONTROL

FIELD OF THE INVENTION

This invention relates to electrical circuits for supplying positive and negative air ions, and more particularly to embodiments of air ionizers that operate on alternating current (AC) and include direct current (DC) biasing for promoting substantially zero residual electrostatic charges on target objects.

BACKGROUND OF THE INVENTION

Air ionizing apparatus that produces both positive and negative air ions can be used to reduce electrostatic charges on various objects such as semiconductor wafers and die during fabrication processes. However, reducing the level of electrostatic charges to the grounded level can be difficult because negative ions are more readily produced and transported through air from an ion generator to the object than positive ions.

Conventional AC air ionizers differ from DC or pulse-type ionizers because all emitter points exhibit the same electrostatic field gradient on applied AC voltage at the same time. There are thus no bipolar potentials on spaced emitter points at any given time as with DC air ionizers, so charge neutralization by AC air ionizers over the area of an object tends to be more uniform. However, the swings in voltages attributable to residual charges on surfaces of objects tend to fluctuate with the frequency at which the AC ion generator produces air ions. Controlling high ionizing voltages, for example, via feedback circuitry to diminish the fluctuations, is generally difficult so lower voltages are used and a reference electrode is disposed adjacent each emitter point to develop the necessary electric field gradient sufficient to produce corona. Certain known AC ionizers apply opposite polarities of the AC voltages to one or more pairs of space emitter points to diminish the AC voltage swings on the target object. Other known AC ionizers rely upon such waveform controls as amplitude or pulse-width or phase modulations to achieve ion balance and reduce voltage variations on the target object.

SUMMARY OF THE INVENTION

In accordance with the illustrated embodiments of the present invention, a reference electrode receives a DC bias voltage as an offsetting potential to alter the mix of positive and negative generated ions. A negative bias voltage is generally required for an isolated system, and for a positive grounded system, but the bias voltage level (and polarity) may have to vary in response to such operating conditions as the ion-generating characteristics of emitter points, and the like, in order to achieve near ground or reference level charge neutralization of a target object.

DESCRIPTION OF THE INVENTION

Figure 1:
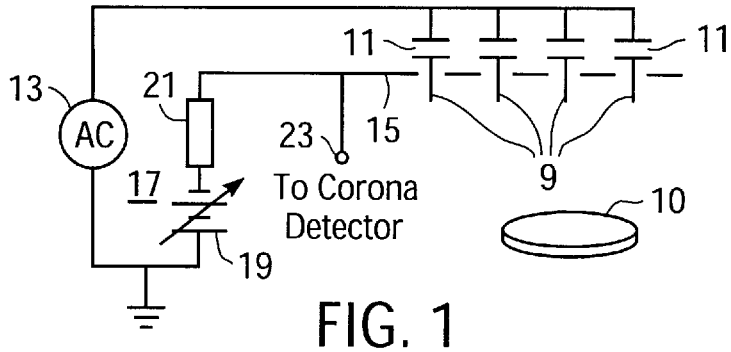
FIG. 1 is a schematic diagram of an AC ionizer with capacitive isolation of emitter points that are positioned near a control electrode.

Referring now to the schematic circuit diagram of FIG. 1, there is shown an array of a plurality of emitter points 9 that are capacitively coupled via capacitors 11 to one terminal of an AC supply 13. A reference electrode 15 such as a bar or rings, or the like, is disposed in close proximity to the emitter points 9, and is connected through a bias source 17 to another terminal of the AC supply 13. The reference electrode 15 promotes high electric field gradients about the emitter points 9 to enhance production of air ions. All emitter points 9 are subjected to the same AC voltage at all times, so no bipolar effect is evident over the area of a target object 10, and the emitter points 9 remain isolated from ground return via the capacitors 11. The bias supply 17 may include an adjustable supply of DC bias 19 and resistive coupling 21 to the reference electrode 15 for varying the voltage thereon over a range of about ±150 volts.

The DC bias 19 is typically set to provide negative DC bias voltage on the reference electrode 15 to enhance production of positive air ions as a result of the asymmetrical field gradients developed around the emitter points 9 relative to the DC bias over each cycle of the AC supply 13. A corona detector, as later described herein, is connected 23 to the reference electrode 15 to detect proper level and polarity of DC bias source 17 sufficient to produce corona and associated production of ions.

Production of air ions from an AC source significantly reduces bipolar effects of ions impinging upon the area of a target object 10, but tends to cause swings in the electrostatic potential of the target object 10 at the frequency of the AC source. High frequency sources may be used to attenuate the magnitude of swings in the electrostatic potential of the target object attributable to the time constants and associated lag times of such electrostatic potential being able to change as rapidly as the high frequency of an AC source. However, high frequency high voltage AC sources are more expensive and commonly suffer from recombination of positive and negative ions produced in rapid succession about the emitter points, and, therefore, become ineffective by and about 1–2 KHz. Accordingly, lower frequency, low voltage AC sources are favored by powering an AC air ionizer with the aid of a reference electrode 15 positioned in close proximity to the emitter points 9.

Figure 2:
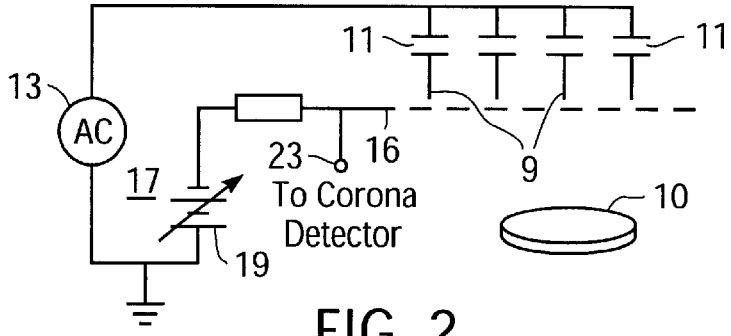
FIG. 2 is a schematic diagram of an AC ionizer with capacitive isolation of emitter points that are positioned behind a control screen.

Referring now to the schematic circuit diagram of FIG. 2, there is shown an array of a plurality of emitter points 9 disposed behind a conductive screen 16 as a reference electrode in a circuit otherwise similar to the circuit that is illustrated and described above with reference to FIG. 1. The screen 16 serves as an isopotential plane which terminates the field gradients about the emitter points 9 and thereby significantly inhibits voltage swings from occurring on the target object 10.

Figure 3:
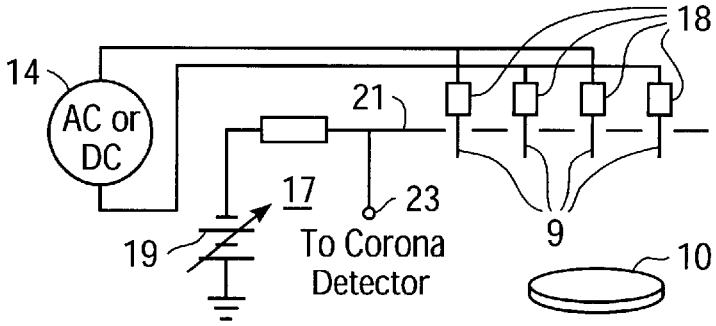
FIG. 3 is a schematic diagram of an air ionizer operable on AC or DC including a source of high ionizing voltage and grouped pairs of emitter points that are connected to respective floating terminals of the source, and that are positioned near a control electrode.

Referring now to the schematic circuit diagram of FIG. 3, there is shown an array of a plurality of emitter points 9 connected in pairs per phase of the ionizing voltage source 14 (AC or DC). Each of the pairs of emitter points 9 is connected to the respective terminal of the source 14 through resistors 18 that limit the current that can flow. The pairs of emitter points per phase (or terminal of opposite polarity) promotes production of ions of both polarities at the same time to significantly diminish the swings of electrostatic potential on the target object 10 under conditions of AC excitation 14. In this embodiment, the ion-generating circuitry 9, 14, 18 'floats' relative to a reference level (e.g., has no current return path to ground), and a grounded DC bias source 17 is connected to reference electrode 21 that is positioned closely about the emitter point 9 as a bar or rings, or the like, to enhance the potential gradients about the emitter points 9 suitable for generating air ions from a low voltage source 14. The DC bias source 17 connected to the reference electrode 21 is variable in amplitude (and polarity) over a range of about ±150 volts to enhance production of positive ions, for reasons as previously described herein. The reference electrode 21 is also connected to a corona detector 23, as later described herein.

Figure 4:
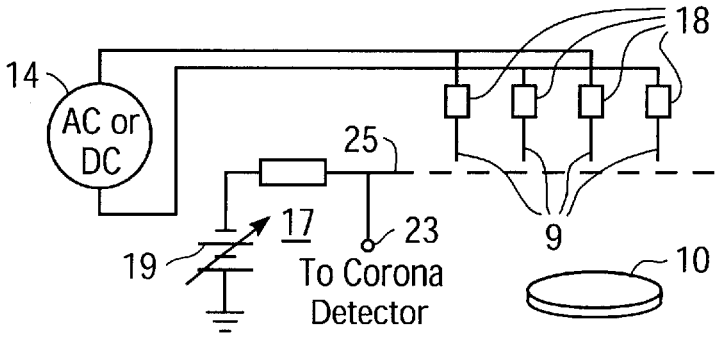
FIG. 4 is a schematic diagram of an air ionizer operable on AC or DC including a source of high ionizing voltage and grouped pairs of emitter points that are connected to respective floating terminals of the source, and that are positioned behind a control screen.

Referring now to FIG. 4, there is shown an array of a plurality of emitter points 9 disposed behind a conductive screen or grid 25 that serves as a reference electrode and that is connected to a variable grounded source 17 of DC bias voltage. The emitter points 9 are connected in phased pairs via resistors 18 to a 'floating' source (AC or DC) 14 of high ionizing voltage. The potential applied to screen 25 thus alters the symmetry of field gradients per half cycle of ionizing voltages from the AC source 14 to promote greater production of positive air ions in the manner as previously described herein. Reference electrode 25 forms an isopotential plane that terminates the field gradients about the emitter points 9 and significantly diminishes variations in the electrostatic potential on the target object 10 attributable to the AC source 14.

Figure 5:
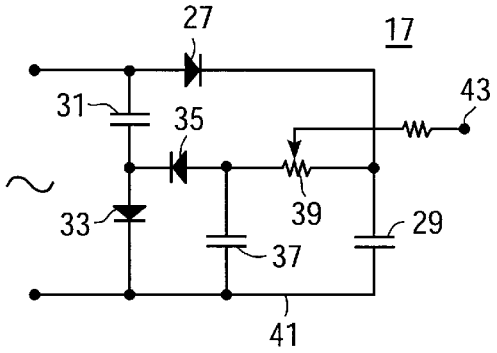
FIGS. 5 and 6 are embodiments of circuits for developing positive and negative DC bias voltages from AC supplies.

Referring now to the schematic circuit diagram of FIG. 5, there is shown one embodiment of a DC bias circuit 17 for operation on applied AC signal to produce DC output bias voltage that is variable over a range of amplitudes and polarities of about ±150 volts (on applied AC of about 120 volts). Specifically, diode 27 is connected to conduct during positive half cycles of the applied AC voltage to charge up capacitor 29, and diode 33 is connected to conduct during the positive half cycles to charge up capacitor 31. During negative half cycles of the applied AC voltage, diode 35 conducts to transfer charge between capacitors 31 and 37 to produce positive and negative voltages across capacitors 29 and 37, respectively, relative to a reference conductor 41. A variable level and polarity of voltage at output 43 may be derived through potentiometer 39 connected between the capacitors 29 and 37 for biasing the reference electrodes 15, 16, 23, 25 in the illustrated embodiments, as previously described herein with reference to FIGS. 1–4.

Figure 6:
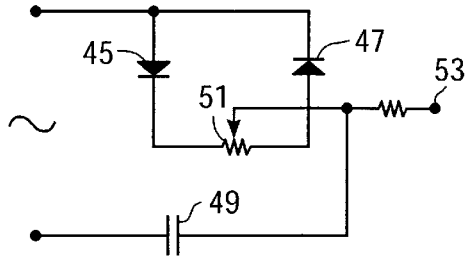

Referring now to FIG. 6, there is shown another embodiment of a DC biasing circuit for operation on applied AC signal. Each of the diodes 45, 47 is connected in conduction phase opposition to the other diode to charge (and discharge) capacitor 49 during alternate half cycles of the applied AC voltage in proportions determined by the setting of potentiometer 51 which therefore determines the level and polarity of DC bias voltage available at output 53 for application to the reference electrodes 15, 16, 23, 25 in the illustrated embodiments, as previously described herein with reference to FIGS. 1–4.

Figure 7:
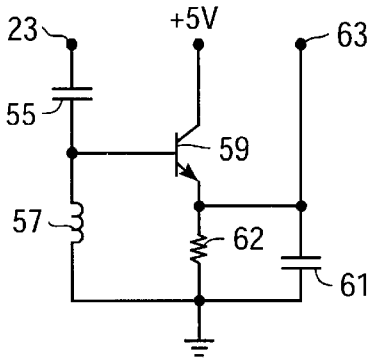
FIGS. 7 and 8 are embodiments of circuits for sensing corona via connection to the control electrodes or screens of the circuit embodiments illustrated in FIGS. 1–4.

Referring now to FIG. 7, there is shown a schematic circuit diagram of a corona detector for connection to the reference electrodes 15, 16, 23, 25 in the illustrated embodiments as previously described herein with reference to FIGS. 1–4. Specifically, the input terminal 23 couples to a series resonant circuit of capacitor 55 and inductor 57, the common terminal of which is connected to the base of transistor 59 that is connected as an emitter follower. The resonant circuit may be tuned to a dominant frequency component of noise that is attributable to corona discharge, as sensed by the reference electrode 15, 16, 23, 25. Transistor 59 exhibits asymmetrical conduction on half cycles of the base signal (that includes a high level resonance component), with resultant charging of the capacitor 61 connected at the output 63. An indicator such as a Light Emitting Diode (LED) or other utilization circuit (not shown) may be connected to output 63 to provide alarm indication of corona activity in the operating conditions associated with the characteristics of the emitter points 9, the setting of bias source 17, and the like.

Figure 8:
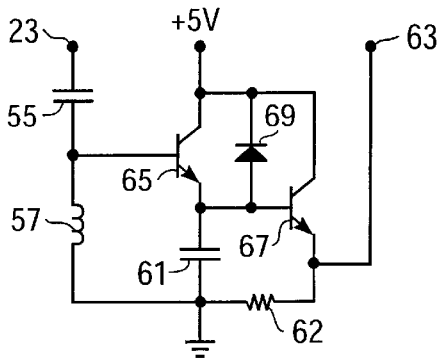

Referring now to FIG. 8, there is shown a schematic circuit diagram of another embodiment of a corona detector in which a first emitter-follower transistor 65 is directly coupled to a second emitter-follower transistor 67. The first emitter-follower transistor 65 receives base signal at the common connection of the resonant circuit including capacitor 55 and inductor 57, and exhibits asymmetrical conduction characteristics on alternate half cycles of the base signal, with resultant charging of capacitor 61 connected to the emitter of transistor 65. The voltage across capacitor 61 is applied to the base of the second emitter-follower transistor 67 which provides a signal on output 63 suitable for energizing an indicator such as an LED or other utilization circuit connected thereto. Such output signal is representative of corona activity in the operating conditions associated with the characteristics of the emitter points 9. Diode 69 is connected in conduction opposition across the emitter and collector of the first transistor to limit excessive signal levels from destroying one or both transistors 65, 67.

Typical values of circuit components are $C_{55}$=100 pFd; $L_{57}$=100 $\mu$H; $C_{61}$=1.0 $\mu$Fd; $R_{62}$=10 KΩ for operation at selected resonant frequency of about 1.6 MHz.

Therefore, the circuitry of the present invention promotes more nearly balanced delivery of positive and negative air ions to a target object in response to separate biasing of a reference electrode positioned in proximity to ion-generating emitter electrodes.

What is claimed is:

1. An air ionizer comprising:

a first plurality of air ionizing electrodes connected to a first conductor;

a second plurality of air ionizing electrodes connected to a second conductor;

a source of ionizing voltages having terminals of opposite polarity connected only to the first and second conductors and having no other ground conduction path for electrical current;

a reference electrode disposed near the first and second pluralities of air ionizing electrodes for establishing electric field gradients between such reference electrode and the air ionizing electrodes; and a source of bias voltage connected to supply bias voltage to the reference electrode relative to ground.

2. Air ionizing apparatus as in claim 1 in which the source of bias voltage supplies bias voltage of selected polarity and amplitude relative to ground.

3. Air ionizing apparatus as in claim 1 in which the source of ionizing voltages includes a first terminal connected to the first conductor and a second terminal connected to the second conductor for supplying AC ionizing voltages to the first and second pluralities of air ionizing electrodes in polarity opposition.

4. Air ionizing apparatus as in claim 3 in which the reference electrode includes a conductive screen disposed in the space between an object and the first and second pluralities of air ionizing electrodes.

5. Air ionizing apparatus comprising:

a first plurality of air ionizing electrodes connected to a first conductor;

a second plurality of air ionizing electrodes connected to a second conductor;

a source of ionizing voltages having terminals of opposite polarity connected only to the first and second conductors and having no other ground conduction path for electrical current;

a reference electrode disposed near the first and second pluralities of air ionizing electrodes for establishing electric field gradients between such reference electrode and the air ionizing electrodes;

a corona detector connected to the reference electrode for sensing corona activity about the pluralities of air ionizing electrodes to produce an output signal indicative thereof; and a source of bias voltage connected to supply bias voltage to the reference electrode relative to ground.

6. Air ionizing apparatus as in claim 5 in which the corona detector includes a resonant circuit connected to receive noise signal from the reference electrode indicative of corona activity; and an amplifier coupled to the resonant circuit for producing an output indication of the corona activity in response to noise signal associated therewith actuating resonance of the resonant circuit.

7. Apparatus for supplying air ions to an object, the apparatus comprising:

a first plurality of air ionizing electrodes spaced away from an object and connected to a first conductor;

a second plurality of air ionizing electrodes spaced away from an object and connected to a second conductor;

a source of ionizing voltages having terminals of opposite polarity connected only to the first and second conductors and having no other ground conduction path for electrical current;

a reference electrode disposed near the first and second pluralities of air ionizing electrodes and interposed in the space between an object and the first plurality and the second plurality of air ionizing electrodes for establishing electric field gradients between such reference electrode and the air ionizing electrodes; and a source of bias voltage connected to supply bias voltage to the reference electrode relative to ground.

8. Air ionizing apparatus as in claim 7 in which the source of bias voltage supplies bias voltage of selected polarity and amplitude relative to ground.

9. Air ionizing apparatus as in claim 7 in which the source of ionizing voltages includes a first terminal connected to the first conductor and a second terminal connected to the second conductor for supplying AC ionizing voltages to the first and second pluralities of air ionizing electrodes in polarity opposition.

10. Air ionizing apparatus as in claim 9 comprising:

a corona detector connected to the reference electrode for sensing corona activity about the pluralities of air ionizing electrodes to produce an output signal indicative thereof.

* * * * *